US005705894A

United States Patent [19]

Krummel

[11] Patent Number: 5,705,894

[45] Date of Patent: Jan. 6, 1998

[54] METHOD FOR OPERATING AT LEAST ONE FLUORESCENT LAMP WITH AN ELECTRONIC BALLAST, AS WELL AS BALLAST THEREFOR

[75] Inventor: Peter Krummel, Traunreut, Germany

[73] Assignee: Siemens Aktiengesellschaft, Munich, Germany

[21] Appl. No.: 718,368

[22] PCT Filed: Jul. 3, 1995

[86] PCT No.: PCT/EP95/02572

§ 371 Date: Sep. 25, 1996

§ 102(e) Date: Sep. 25, 1996

[87] PCT Pub. No.: WO96/03017

PCT Pub. Date: Feb. 1, 1996

[30] Foreign Application Priority Data

Jul. 19, 1994 [EP] European Pat. Off. ..... 94111248

[51] Int. Cl.[6] ..... H05B 37/00

[52] U.S. Cl. ..... 315/119; 315/224; 315/209 R; 315/307; 315/360; 315/DIG. 7

[58] Field of Search ..... 315/119, 127, 315/224, 225, 244, 291, 209 R, 307, 308, DIG. 4, DIG. 5, DIG. 7, 360

[56] References Cited

U.S. PATENT DOCUMENTS

| | | | |
|---|---|---|---|
| 4,616,158 | 10/1986 | Krummel et al. | 315/225 |
| 5,049,790 | 9/1991 | Herfurth et al. | 315/291 |
| 5,424,613 | 6/1995 | Moriarty, Jr. | 315/209 R |
| 5,583,399 | 12/1996 | Rudolph | 315/291 |

FOREIGN PATENT DOCUMENTS

| | | |
|---|---|---|
| 0 338 109 A1 | 10/1989 | European Pat. Off. . |
| 0 359 860 A1 | 3/1990 | European Pat. Off. . |
| 0 558 772 A1 | 8/1993 | European Pat. Off. . |
| 34 32 266 A1 | 3/1985 | Germany . |

OTHER PUBLICATIONS

From the journal "Licht" [Light] No. 1/1987, Elektronische Vorschaltgeraete, Peter Heinrich, pp. 45–48.

From the journal "Licht" [Light] No. 2/1987, Elektronische Vorschalgeraete, Peter Heinrich, pp. 148–154.

*Primary Examiner*—Robert Pascal
*Assistant Examiner*—Haissa Philogene
*Attorney, Agent, or Firm*—Hill, Steadman & Simpson

[57] ABSTRACT

The method operates at least one fluorescent lamp (FL) using an electronic ballast. The ballast has a rectifier bridge (GL) which has AC mains voltage (L, N) across it, a connected step-up converter (L1, D1, V1), a half-bridge circuit (V2, V3) as well as a control loop (IC) for continuously monitoring the lamp current by means of a controlled drive circuit (CCO, SEL, HSD, LSD) of the power transistors (V2, V3), which drive circuit keeps the lamp current constant during normal operation. A timer (PST, IT, CT), which is started in a defined manner each time the lamp is started or a disturbance is detected, generates as superordinate control a time base for a monitoring circuit (MON). The monitoring circuit evaluates the instantaneous lamp current using predetermined reference levels (Mp, Mi and Mo) which vary in individual time segments (Δpt, Δit, Δst, Δot) and controls the lamp current as a function of time by means of the controlled drive circuit (CCO, IST, SEL, HSD, LSD) in the case of normal starting of the lamp or triggers automatic disconnection of the electronic ballast in the case of a fault.

17 Claims, 5 Drawing Sheets

METHOD FOR OPERATING AT LEAST ONE FLUORESCENT LAMP WITH AN ELECTRONIC BALLAST, AS WELL AS BALLAST THEREFOR

BACKGROUND OF THE INVENTION

The invention relates to a method and apparatus for operating at least one fluorescent lamp using an electronic ballast.

It is known to operate fluorescent lamps by means of electronic ballasts at high frequency in the context of a limited lamp current with a predetermined constant power and increased economy compared with other conventional circuit arrangements used for lamp operation. Therefore, fully electronic ballasts have already become accepted to a large extent and are known in a multiplicity of individual solutions. For example, reference is made in this connection to the articles in the journal "Licht" [Light] No. 1/1987, pages 45 to 48 and "Licht" No. 2/1987, pages 148 to 154 with further literature references.

Fully electronic ballasts are universal devices which can be used advantageously for conventional AC mains voltages in a relatively broad tolerance range, a broad range of permissible mains frequencies and, finally, are even suitable for DC voltage supply. However, an essential problem in the case of electronic ballasts is based on the fact that lamp tolerances have to be taken into account and a variety of disturbances of lamp operation on account of a variety of causes can occur and must be reliably detected. Thus, for example, a fluorescent lamp which has become untight behaves completely differently in operation compared with an aged fluorescent lamp having an increased filament resistance on account of the aging process, and, in turn, a distinction can be made between these cases and disturbances on account of the occurrence of a broken filament. In all these cases, the disturbance must be identified unambiguously as a fault which is endangering the electronic ballast, if appropriate even the load circuit with the defective fluorescent lamp, too, and the driving of the defective fluorescent lamp must be deactivated. However, disturbances occurring briefly in the supply network, too, can additionally influence the lamp operation; in this case the lamp current must be limited to permissible values, on the other hand brief disturbances of this type should not lead to the disconnection of the lamp. Finally, it is desired for maintenance reasons and also already known to put the electronic ballast into a reset standby state when a lamp fault has occurred, from which standby state an automatic restart of the exchanged lamp can take place after a lamp change, i.e. for eliminating the fault.

For the reasons outlined and on account of the fact that in some instances considerable voltage spikes occur at least in the actual load circuit, thoroughly narrow limits are imposed on the configuration of fully electronic ballasts in terms of circuitry. It is therefore customary to construct electronic ballasts at least predominantly using analog circuit technology, which in many cases stands in the way of integration for an electronic ballast. Commercially available electronic ballasts are therefore relatively extensive circuits having a multiplicity of discrete components, and the production and testing are correspondingly complicated and expensive.

SUMMARY OF THE INVENTION

It is therefore a purpose of the present invention, on the basis of an analysis of the operations proceeding during starting of the lamp and on the basis of the monitoring functions resulting from various causes of disturbances, to provide a basis for a functional principle which allows the electronic ballast to be implemented using integrated circuit technology to a significantly higher degree than was customary hitherto.

Therefore, the present invention is based on the object of providing a method of the type mentioned in the introduction which permits, during normal lamp operation, simple and reliable control of the power converted in the load circuit, containing at least one fluorescent lamp, with the fluorescent lamp to a constant value, and which allows at the same time, by means of superordinate monitoring of the functioning of the lamp, an unambiguous evaluation of all the states in unstable regions, that is to say during starting of the lamp, but also in the event of the various disturbances, and allows the initiation of a reset of the electrical lamp circuit in the event of a lengthy disturbance which endangers this lamp circuit, which reset permits renewed starting of the lamp circuit, if appropriate automatically, once the disturbance has been eliminated. Furthermore, the present invention is based on the object of providing an electronic ballast of the type mentioned in the introduction which is correspondingly constructed for the application of a method of this type and, in particular, can be implemented largely using integrated circuit technology.

In general terms the present invention is a method for operating at least one fluorescent lamp using an electronic ballast which has a rectifier bridge having AC mains voltage across it, a charging inductor which is connected to the output side of the rectifier bridge. A connected charging diode is fed back to the rectifier bridge via a shunt capacitor. A half-bridge circuit is connected to the charging diode, is fed back to the rectifier bridge and has two power transistors which are in series with one another and are activated alternatively. A control loop has a monitoring circuit for continuously monitoring the lamp current and a high-frequency controlled drive circuit, derived from the said monitoring circuit, for the power transistors. The ballast is connected to a load circuit which is arranged at the output of the half-bridge circuit and has at least one fluorescent lamp, an ignition inductor and an ignition capacitor. A timer is started in a defined manner each time the lamp is started and each time a disturbance occurs during lit operation. The timer generates a time base for subsequent control operations and, for this purpose, respectively emits time control signals at predetermined instants. Using these predetermined time control signals, different reference levels for the lamp current to be detected are set in the monitoring circuit or automatic disconnection of the electronic ballast for a predetermined, limited period of time is prepared. The monitoring circuit compares the instantaneous value of the lamp current with the respectively activated reference level and emits a respective control pulse once this reference level has been reached. These control pulses, which reproduce normal or alternatively faulty states in the load circuit as a function of their occurrence or failure to occur during predetermined periods of time defined by the timer, control the lamp current as a function of time. They act on the controlled drive circuit, in the event of an undisturbed operating state, or the control pulses trigger the prepared automatic disconnection of the electronic ballast in the case of a fault.

Advantageous developments of the method of the present invention are as follows.

The time base supplied by the timer begins, during starting of the lamp, with a preheating phase. This is adjoined in direct chronological order by an ignition phase having a maximum duration, a disconnection phase as well as a normal operating phase. If a disturbance is detected during the normal operation, the time base begins directly at the ignition phase, with the exclusion of a preheating phase. At each transition instant from one time phase to the following time phase, the timer generates one of the time control signals respectively assigned to these instants.

The monitoring circuit, a first reference level, which limits the lamp current to a relatively low value, is activated during the preheating phase. A significantly higher, second reference level, which is sufficient to generate an increased ignition voltage across the fluorescent lamp, is activated in the ignition phase which comes next during starting of the lamp. A third reference level lying between the two other reference levels is activated in the normal operating phase. As a result an increase, which may also be only brief, in the lamp current above a predetermined value is detected as a disturbance, whereupon fault monitoring is triggered using the timer which is then reactivated from a standby state assigned to normal operation.

Automatic disconnection, prepared at the beginning of the disconnection phase, of the electronic ballast is only triggered when, in this disconnection phase, the monitoring circuit continues to exist at least one control pulse and hence signals an impermissibly increased lamp current.

The driving of the power transistors of the half-bridge circuit is inhibited in the controlled drive circuit as a result of the automatic disconnection of the electronic ballast. This disconnection function is maintained for as long as the power supply of the integrated control loop is not interrupted.

In general terms the present invention is also an electronic ballast for operating at least one fluorescent lamp, the ballast having a rectifier bridge having AC mains voltage across it, a step-up converter which is connected to the output side of the rectifier bridge. A half-bridge circuit which is connected to the step-up converter, is fed back to the rectifier bridge and has two power transistors which are in series with one another and can be activated alternatively. A control loop has a monitoring circuit for continuously monitoring the lamp current and a high-frequency controlled drive circuit, derived from the monitoring circuit, for the power transistors. A load circuit has the at least one fluorescent lamp, an ignition inductor and an ignition capacitor arranged at the output of the half-bridge circuit. The monitoring circuit, which is coupled to the half-bridge circuit, is designed as a threshold value comparator which has a plurality of individually activatable reference levels and generates a respective control pulse as soon as the pulse-shaped lamp current reaches the instantaneously activated reference level. There is assigned to the monitoring circuit a controllable timer, which automatically builds up oscillations during starting of the lamp, or when a disturbance is detected, and prescribes for the control loop a time base with a series of defined periods of time. The series of defined periods of time is assigned a respectively predetermined control signal which is emitted at the output of the timer and by means of which in each case one of the reference levels can be activated in the monitoring circuit. A disconnection circuit is provided for resetting the drive circuit in the case of a fault, to which disconnection circuit, which is connected on the input side to the timer, one of the control signals emitted by the latter is fed as an enable signal and to which disconnection circuit, which is also connected to the output of the monitoring circuit, is triggered by the output-side control pulses of the latter and keeps the electronic ballast reset for as long as the power supply of the control loop via the AC mains voltage is maintained.

A control input of the internal current source is connected to the output of the monitoring circuit, with the result that the internal current source is activated by the control pulses of the monitoring circuit.

The timer is furnished with four threshold values for evaluating the charging voltage rising continuously across the charging capacitor. The end of the first period of time, defined as the preheating phase, as well as the beginning of the second period of time, defined as the ignition phase having a predetermined maximum duration, are established when the charging voltage passes through a first, low threshold value. The transition from the ignition phase to a disconnection phase is determined by the passage of the charging voltage through the second threshold value. The end of the disconnection phase is reached when the charging voltage passes through the third threshold value having the maximum level, and the fourth threshold value, the level of which lies between the first threshold value and the second threshold value, corresponding during steady-state lit operation of the fluorescent lamp to an operating level at which the timer is kept in a standby state.

The monitoring circuit designed as a further threshold value comparator has three reference levels which can be individually activated by means of the timer. A first reference level is assigned to the preheating phase, during which the monitoring circuit, limiting the lamp current, generates a series of control pulses in this preheating phase. A second, high reference level is assigned to the ignition phase and the subsequent disconnection phase, during which the monitoring circuit continues to emit control pulses for as long as ignition attempts continue. A third reference level, which may, if appropriate, be identical to the first reference level, is assigned to the steady-state operation of a fluorescent lamp which is lit without any faults, in which state the monitoring circuit is in a standby state and does not emit any control pulses.

In the drive circuit a selection circuit has two mutually inversely activated outputs via which in each case one of the two power transistors of the half-bridge circuit can be driven alternatively and has a first control input connected to the output of the monitoring circuit as well as a further control input. A current-controlled radio frequency oscillator is coupled on the input side to the half-bridge circuit, an output being connected to the second control input of the selection circuit. The radio frequency oscillator including a control loop keeps the lamp or half-bridge current constant at a predetermined mean, in particular during steady-state lit operation of the fluorescent lamp. Superordinate current control, which identifies, limits and controls a peak current during starting of the lamp as well as in the case of a disturbance, is provided in conjunction with the monitoring circuit.

There is provided for the control loop a controlled power supply having an input for the supply voltage which is connected via a further capacitor to a reference potential, preferably ground, and is connected in parallel therewith, via a series circuit of two diodes, likewise to the reference potential. A further capacitor is connected to the junction point of the diodes and the output of the half-bridge circuit. An electronic switch is provided for the regulated control of the charge of this further capacitor and is controlled such that it is activated once the supply voltage has exceeded a predetermined upper tolerance value. The switch is inhibited again when the supply voltage has fallen below a predetermined lower tolerance, and the charge of the further capacitor is fed once more to the capacitor.

The electronic switch is designed as a switching transistor and is arranged with its collector-emitter path between the junction point of the two series-connected diodes and a reference potential, in particular ground. A low-inertia, further comparator is provided, to which is fed the supply voltage for the purpose of evaluation with regard to upper and lower threshold values and to the output of which is connected the control input of the switching transistor.

The power supply of the control loop additionally has a voltage-proof turn-on comparator, which is connected to the input for the supply voltage, has a high input resistance until a predetermined starting voltage is reached. The output of the comparator is connected a DC voltage source for generating a reference voltage as a defined reference potential for control operations in the control loop as well as, in parallel therewith, a further controlled current source for the internal DC supply of the control loop.

The turn-on comparator is connected by a control input to the output of the disconnection circuit, via which control input the turn-on comparator can be switched into its high-resistance state in the reset state of the control loop.

There is assigned to the current-controlled radiofrequency oscillator a further internal, controlled current source having a set input connected to the monitoring circuit and a reset input connected to one of the outputs of the selection circuit. The output of the current source is connected via a further external capacitor to the reference potential or the connection of the rectifier bridges which carries a low potential. A control operational amplifier is provided, to the non-inverting input of which, which is connected via a further series resistor to the output of the half-bridge circuit is fed an input signal corresponding to the instantaneous value of the lamp current, and to the inverting input of which, which is connected to a junction point between the controlled internal current source and the external capacitor, is fed an input signal corresponding to the charge state of this capacitor, and the output of which, which is decoupled by means of a decoupling diode, is connected to the junction point between the controlled internal current source and the external capacitor, as well as, to a control input of the current-controlled oscillator.

A further differential voltage amplifier is used as a comparator, the inverting input of which is connected to the reference voltage as the reference potential and the non-inverting input of which is connected via the decoupling diode to the output of the control operational amplifier. As a result it is possible to detect by means of this comparator when the control operational amplifier leaves its defined control range, whereupon the comparator generates a control signal which is fed to the monitoring circuit and effects in the latter a lowering of its predetermined reference levels.

For normal lit operation, the solution according to the invention envisages driving, by means of a first control loop the half-bridge circuit which is formed by two power transistors and is connected upstream of the load circuit containing the at least one fluorescent lamp, which first control loop keeps the power converted in the load circuit constant at a predetermined value. In addition, a second control loop is provided, which is superordinate to the former control loop and is in a standby state during steady-state lit operation. It is activated from this standby state only on account of a disturbance of the steady-state operation, which disturbance may also be brief and can be identified by an increased lamp current. The monitoring function thus triggered proceeds on the basis of a predetermined time frame, in which specific lamp current values are established in each case in successive time segments and it is thus finally determined whether the disturbance which has occurred—endangering the lamp circuit—has to lead to a reset of the electronic ballast and hence of the drive of the load circuit, too. Furthermore, the same superordinate control loop is also used for controlling and monitoring the lamp current during starting of the lamp irrespective of whether this lamp starting is proceeding normally, that is to say the connected lamp is igniting normally, or whether it is proceeding with disturbances in the case of a defective fluorescent lamp. In this case, it is particularly advantageous that it is possible to set monitoring states in a defined manner using a time frame which is simple to implement and consists of only a few time segments, in which monitoring states the instantaneous lamp current can be unambiguously evaluated in respect of a fault which has occurred. Although the monitoring function is started even in the event of disturbances which occur only briefly, such a disturbance, which directly readjusts the lamp current, is suppressed and the electronic ballast continues to operate normally after such a disturbance has died away. On the other hand, actual lamp defects can be unambiguously established as such in a short time and effect a reset of the electronic ballast, which automatically carries out renewed starting of the lamp after the fault which occurred has been eliminated, that is to say after a lamp change or after disconnection and reconnection of the mains voltage.

Advantageous developments of the apparatus of the present invention are as follows.

The timer includes a controllable internal current source, the output of which is connected to a charging capacitor, as well as a further threshold value comparator having a plurality of predetermined threshold values. The input of the further threshold value comparator is connected to the junction point between the internal current source and the charging capacitor. The further threshold value comparator generates, as a function of the charging of the charging capacitor, the assigned control signals, defining the predetermined periods of time, by means of a threshold value comparison. It is evident from this that the timer provided according to the invention controls the monitoring circuit cooperating with it in a defined manner in such a way that it can evaluate as a function of time the instantaneous lamp current in different time segments and in different ways, and furthermore limits the said current in each case to a defined maximum value, in that the actual drive circuit for the power transistors of the half-bridge circuit is set accordingly by control pulses which are output by the monitoring circuit. In this way, the lamp current is limited, for example, in the preheating phase to a low value which does not damage the filaments of the fluorescent lamp, but on the other hand a higher ignition current with a predetermined peak value corresponding to a maximum permissible ignition voltage is set, with a narrow tolerance, in the ignition phase and, finally, is also limited in the case of a disturbance even during the monitoring phase, with the electronic ballast not as yet reset, to permissible values to permissible values [sic] which cannot yet endanger the entire lamp circuit.

Furthermore, this solution also permits universal use of the electronic ballast, since it is possible to take account of the corresponding marginal conditions during multi-lamp operation or alternatively dimming operation of the electronic ballast by means of corresponding selection of the comparison levels in the monitoring circuit and indeed of the actual driving of the power transistors.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
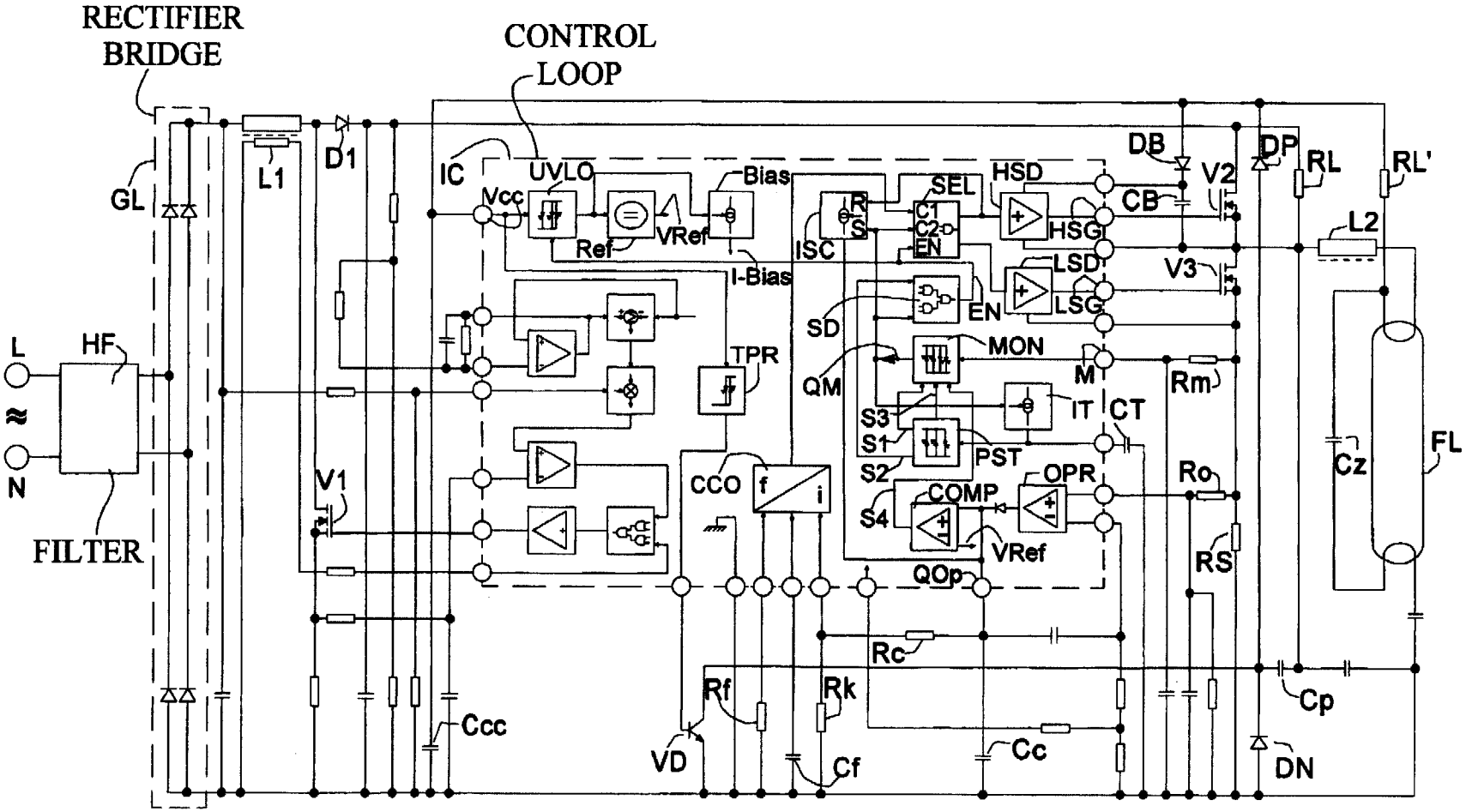
FIG. 1 shows a block diagram of an electronic ballast designed according to the invention.

FIG. 1 illustrates an electronic ballast for operating a fluorescent lamp, if appropriate a plurality of fluorescent lamps, too, as well as the actual load circuit with the fluorescent lamp FL. It is known to connect electronic ballasts to the AC mains, here designated by L, N, via a radiofrequency filter HF for the purpose of limiting the radio interference voltage. A rectifier bridge GL, which supplies an unsmoothed DC voltage, is present at the output of the radiofrequency filter HF. In order to generate a DC voltage which is above the peak value of the mains voltage, a charging inductor L1 connected to a charging diode D1 is provided at the output of the rectifier bridge. The charging inductor L1 is periodically charged via a first power transistor V1 which is likewise connected to its output. This first power transistor V1 is controlled by means of a control loop, which is designed here, in particular, as an integrated circuit IC and will be described in more detail. Put simply, one task of this control loop in electronic ballasts is to charge the charging inductor L1 to a varying degree as a function of the instantaneous value of the rectified mains voltage, the control loop limiting harmonics in the mains current. A second function is to control the voltage occurring across the cathode output of the charging diode D1, the so-called intermediate circuit voltage, to a constant value with a low degree of fluctuation, in order to obtain load and mains voltage independence in the electronic ballast.

Furthermore, electronic ballasts usually have a self-oscillating inverter, with a half-bridge circuit which is implemented here by two further power transistors V2 and V3 situated in a series circuit connected to the charging diode D1. The load circuit with at least one fluorescent lamp FL is connected to the common junction point of these two further power transistors. In this exemplary embodiment, there is provided here for a load circuit a saturable reactor L2 situated in series with the fluorescent lamp FL, an ignition capacitor Cz is connected in parallel with the fluorescent lamp FL. Insofar as it is described above, the electronic ballast according to the invention corresponds to customary embodiments and therefore does not need to be described in more detail.

All the control functions of the electronic ballast are essentially implemented in the already mentioned control loop which is designed as an integrated circuit IC. For the driving of the two further power transistors V2 and V3, this integrated circuit IC has in each case a driver circuit HSD and LSD, respectively, which, for their part, are respectively situated at two mutually inverse outputs of a selection circuit SEL. In this case, the driver circuit HSD contains a potential-bridging level converter, which changes the drive signal to the high potential of the power transistor V2. The said driver circuit has a turn-on input EN to activate and deactivate it, as will be explained in more detail. A pulse train is fed to the selection circuit SEL at a control input C1, which pulse train controls the selection circuit in the manner of a flip-flop, with the special feature that the power transistors V2 and V3 which are activated via the driver circuits HSD and LSD, respectively, are driven alternatively but staggered with respect to one another by a defined dead time. This controlling pulse train is supplied by a controlled oscillator CCO, which has three setting inputs to which are connected a first variable resistor Rf, a second variable resistor RK and a variable capacitor Cf with respect to earth—or alternatively with respect to a defined reference voltage (by way of example, the further description will always refer to earth here). The variable resistor RK and the variable capacitor Cf determine the lower and the upper limiting frequency, respectively, of the oscillator CCO which is controlled as a function of current in this example. The prescribed dead time of the power transistors V2 and V3 can be set via the dimensioning of the variable resistor Rf.

The controlling input information for the oscillator CCO which is controlled as a function of current is supplied by the output information from a first operational amplifier OPR which is low-pass filtered via a further non-reactive resistor Rc and a further capacitor Cc.

As will be explained further, a reference voltage Vref is generated internally in the integrated circuit IC. The first operational amplifier OPR compares this reference voltage with a second input voltage, which corresponds to the mean of the current flowing through the power transistors V2 and V3 of the half-bridge circuit. For this purpose, this second input of the operational amplifier OPR is connected via a series resistor Ro to the current path of the half-bridge circuit, that is to say here the output of the power transistor V3. This circuit arrangement for controlling the lamp current flowing in the half-bridge circuit represents a closed control loop, since the higher this lamp current rises, the higher the output voltage of the operational amplifier OPR becomes, too, which output voltage, on the other hand, controls the controlled oscillator CCO towards a higher pulse train frequency. However, this frequency increase effects, for its part, a reduction in the lamp current. This control loop also acts in an analogous manner in the opposite direction, for a decreasing trend of the lamp current. In steady-state operation, that is to say when the fluorescent lamp is lit without any disturbances, this above-described control loop, in particular with the oscillator controlled as a function of current and the first operational amplifier OPR, forms an effective high-frequency controller for the driving of the half-bridge circuit. To expand on this, the electronic ballast described here is also dimmable, since it is possible to control the output power of the electronic ballast by means of corresponding fixing of the reference voltage Vref.

Furthermore, the integrated circuit IC contains a monitoring arrangement which monitors the state of the fluorescent lamp FL during a steady-state operation, in particular controls starting of the lamp and is also activated when faults or disturbances occur. To this end, the integrated circuit IC has a monitoring circuit MON, which is designed as a threshold value circuit with threshold values which can be set and is connected, in turn, by its signal input via a series resistor Rm to the output of one power transistor V3 of the half-bridge circuit. This monitoring circuit MON thus receives a control signal which corresponds to the instantaneous lamp current and always effects an output pulse QM from the monitoring circuit MON as soon as the instantaneously activated threshold value is reached. The respective threshold value is set by means of a plurality of selection signals.

One of these selection signals S4 is generated by a first comparator COMP, which is designed as a differential voltage amplifier, is connected by its positive input via a decoupling diode D2 to the output of the first operational amplifier OPR and to which the reference voltage Vref is fed via its negative input.

Further selection signals are generated by a timer PST which is connected on the input side to the junction point of a first internal current source IT and an external charging capacitor CT connected to earth. This internal current source IT is activated at the start of a turn-on operation for the fluorescent lamp FL and begins to charge the external charging capacitor CT, with the result that a linearly increasing signal voltage corresponding to the instantaneous duration of the turn-on operation is present across the input of the timer PST. This signal voltage is compared in the timer PST with predetermined threshold values. When the respectively activated threshold value is reached, the timer PST outputs in each case one of the output signals S1, S2 and S3 and thus defines specific time segments which will be described in more detail. The first and the third output signal S1 and S3, respectively, are each fed to the monitoring circuit MON in order to set there one of the predetermined threshold values.

The comparator COMP compares the voltage across the external capacitor Ccc, which corresponds during normal operation to the output voltage of the control operational amplifier OPR, with a value predetermined by the reference voltage Vref. If the control operational amplifier leaves its defined control range—this is possible, in particular, in the dimming state in the case of multi-lamp applications or alternatively in the case of lamp defects caused, for example, by aged, high-resistance lamp filaments—then this is identified by the comparator COMP. The latter generates the control signal S4 which is used to set in the monitoring circuit MON a state in which all the reference levels Mp, Mi and Mo are considerably reduced. The monitoring circuit MON then operates, therefore, satisfactorily even at relatively low lamp currents.

The second output signal S2 of the timer PST forms a preparation signal for a disconnection circuit SD, which is designed as a logic circuit and performs the function of shutting down, if appropriate, the half-bridge circuit with the further power transistors V2, V3 in the event of a disturbance, for example in the event of a lamp fault. In order to realize this, a control input of the disconnection circuit SD is connected to the output of the monitoring circuit MON. An output of the disconnection circuit SD is connected, inter alia, to the turn-on input EN of the selection circuit SEL, in order to enable or reset the latter.

Furthermore, there is provided in the integrated circuit IC a second internal current source ISC, the output of which is connected to the junction point between the non-reactive resistor Rc and the capacitor Cc of the external low-pass filter. This second internal current source ISC has a set input S and a reset input R. The set input S is connected to the output of the monitoring circuit MON, whereas the reset input R is connected to the output of the selection circuit SEL for the driver circuits HSD and LSD of the power transistors V2 and V3, respectively, of the half-bridge circuit. This second internal current source ISC is set by an output pulse from the monitoring circuit MON and charges the external capacitor Cc of the low-pass filter Rc, Cc. Since the oscillator CCO which is controlled as a function of current is likewise connected by its control input to this output of the second internal current source ISC, the input current connected to the said oscillator increases, with the result that its output pulse train frequency is increased. As soon as the selection circuit SEL in one of its two mutually inverse switching states then activates the driver circuit HSD which is assigned to that power transistor V2 of the half-bridge circuit which has a high voltage across it, the second internal current source ISC is reset by the same output signal from the selection circuit SEL. In this way, a further closed control loop is given, which controls the lamp current cycle by cycle to the respectively prescribed value which is defined by the instantaneously activated threshold value of the monitoring circuit MON. This second control loop is superordinate to the current controller described in the introduction for steady-state operation and limits and controls the lamp current during starting of the lamp as well as in the event of detected cases of disturbances.

A defined power supply of the integrated circuit IC is achieved by a number of circuit measures. In particular, a turn-on comparator UVLO is provided for the connection operation, the input of which comparator is connected, for example, directly to the rectifier bridge GL via a further series resistor and is connected to earth via a further charging capacitor Ccc. A supply voltage Vcc is fed to the integrated circuit IC at this input of the turn-on comparator UVLO. Another possible way of feeding the supply voltage Vcc to the integrated circuit IC is illustrated in FIG. 1, which uses series resistors RL, RL' to make it possible to detect and utilize state changes in the load circuit, as will be explained in more detail. The turn-on comparator UVLO initially has a high input resistance, in order to activate IC function with as few losses as possible. It is furthermore designed in such a way that it already responds at voltage values which are as low as possible, for example of the order of magnitude of not more than 150 V DC in an AC mains voltage supply of 220 V, as soon as the charging capacitor Ccc has been charged accordingly after the connection of the AC mains voltage L, N. An internal voltage source REF, which generates the mentioned reference voltage Vref, is thus activated. In addition, a further internal current source BIAS is connected to the turn-on comparator UVLO, by means of which current source an internal auxiliary voltage IC-BIAS is generated for the integrated circuit IC. These measures make it possible to start the integrated circuit. Reference is made to the possibility of deactivating the turn-on comparator UVLO not only by means of disconnecting the mains voltage L, N, but also internally by means of a control input connected to the output of the disconnection circuit SD; the IC function can consequently be turned off in a defined manner.

During normal operation, the power supply of the integrated circuit IC is ensured—in this exemplary embodiment—by a supply circuit DP, DN, Cp which operates with virtually no losses and comprises a series circuit formed by two pumping diodes DP and DN as well as a further charging capacitor Cp. The latter is connected, on the one hand, to the junction point of these two diodes and, on the other hand, to the output of the half-bridge circuit, that is to say the junction point of the two power transistors V2 and V3. This supply circuit supplies the supply voltage Vcc for the integrated circuit IC during normal operation.

A control loop with a further comparator TPR is provided for keeping this supply voltage Vcc constant, the said comparator compares the instantaneous value of the supply voltage Vcc with an upper and a lower predetermined reference value in each case. The output of this comparator TPR is connected to the control connection of an electronic switch VD, which is designed here as a transistor switch and the switching path of which is arranged between the charging capacitor Cp of the supply circuit and earth. If the instantaneous value of the supply voltage Vcc detected by the comparator TPR exceeds the predetermined upper limit value, the comparator TPR outputs an output signal which switches on the electronic switch VD, The latter consequently discharges the charging capacitor Cp of the supply circuit DN, DP, Cp until the comparator TRP, which operates as far as possible without any delay, detects the lower limit value of the supply voltage Vcc and turns the electronic switch VD off again. Therefore, this is high-low control of the supply voltage Vcc.

Figure 2:
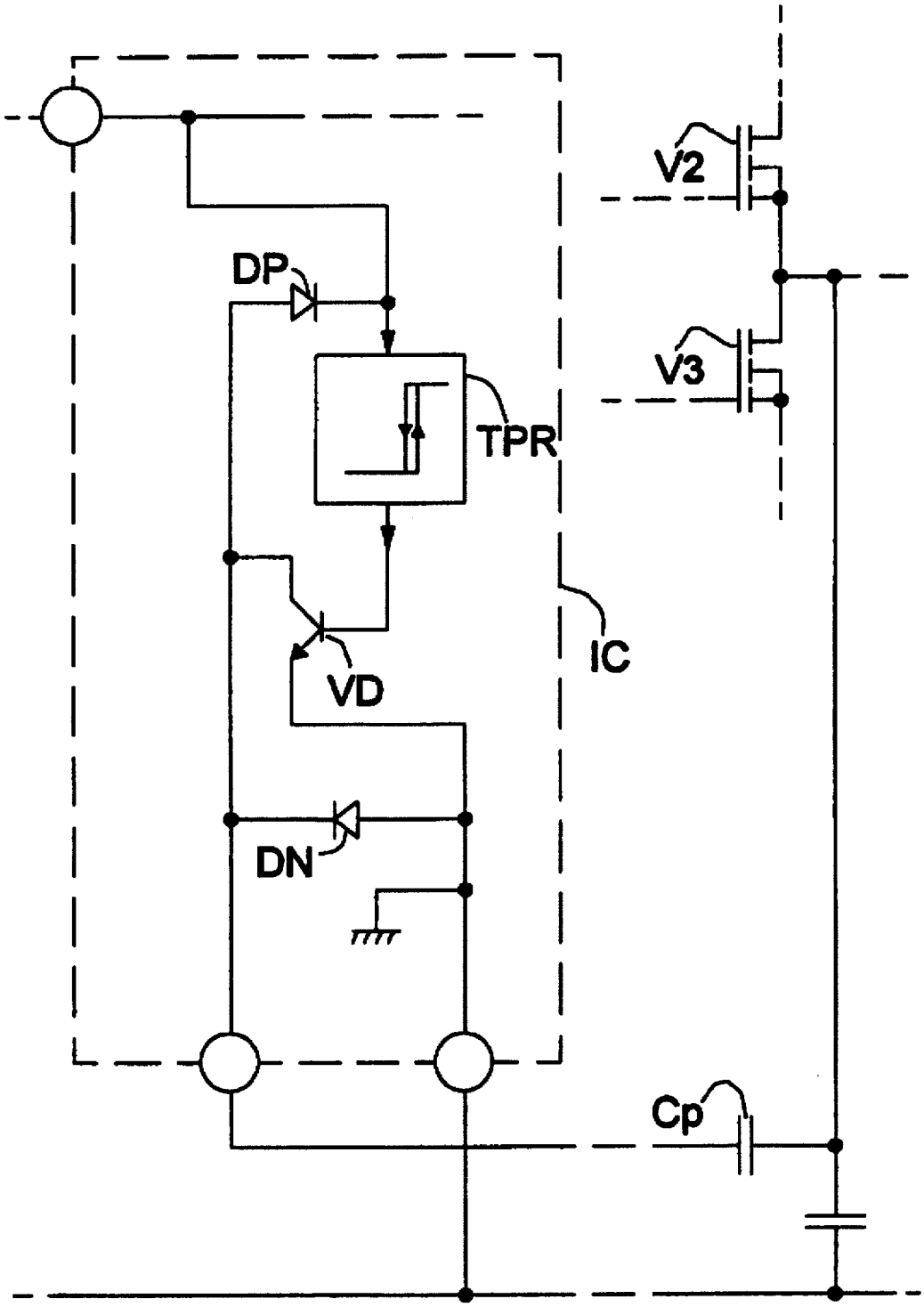
FIG. 2 shows a further circuit detail of a second embodiment.

As is shown in a circuit diagram detail according to FIG. 2, the pumping diodes DN, DP of the above-described supply circuit as well as the electronic switch VD may also be integrated in the integrated circuit IC. The circuit function described does not change in the process.

Finally, an arrangement PFC for controlling the power factor is additionally implemented in the integrated circuit IC. It is completely similar in terms of configuration to corresponding known controllers for improving the power factor. Although this function is necessary in the integrated circuit IC, it is only referred to here because it is of secondary importance in the context provided here. This arrangement PFC detects all the parameters which are necessary for determining the power factor at the charging inductor L1, which is also equipped with an auxiliary winding for this purpose, evaluates them and drives the first power transistor V1 accordingly.

Figure 3:
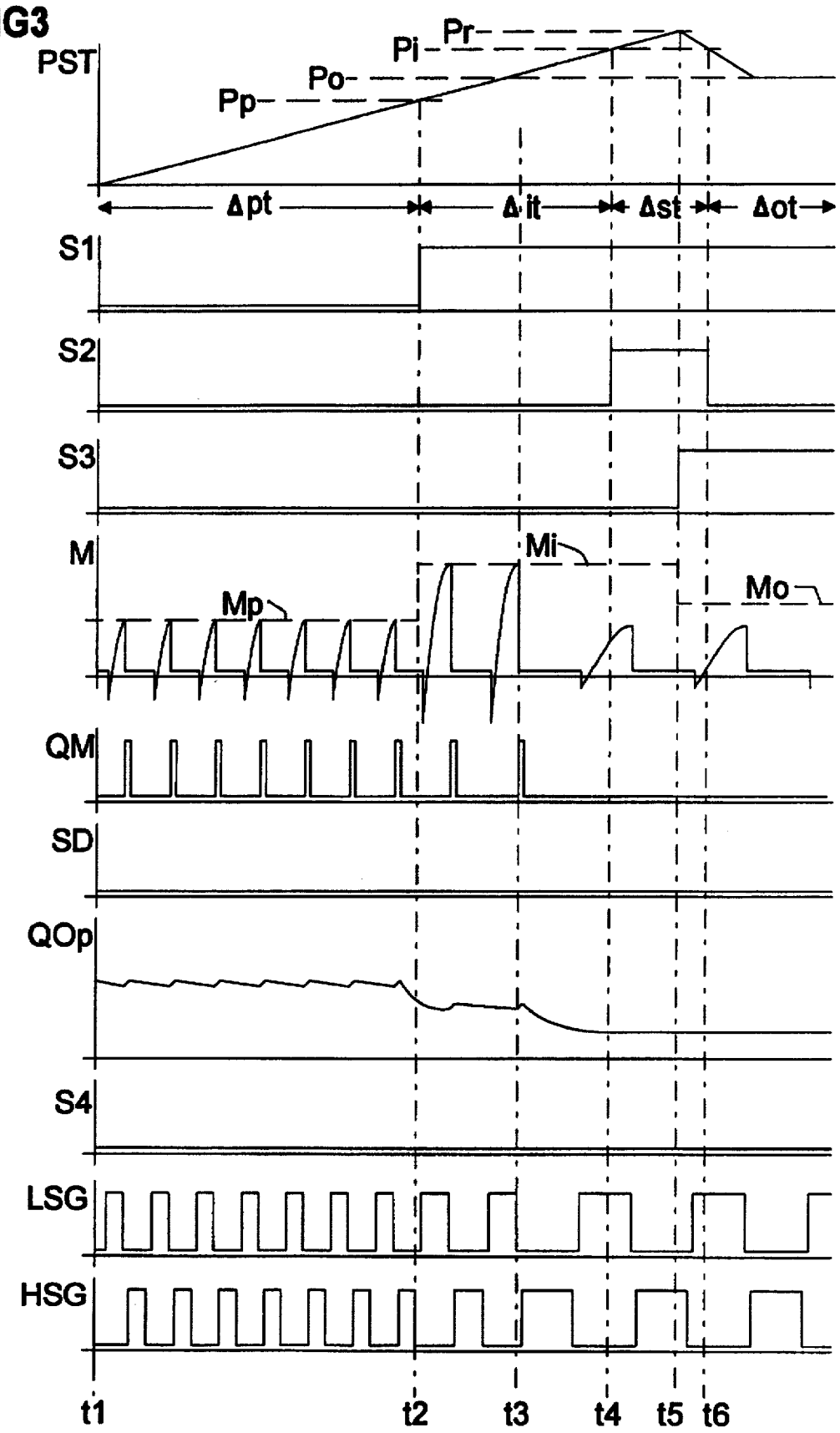
FIG. 3 shows, in the form of timing diagrams, the functional sequence for lamp starting which is proceeding normally.
Figure 4:
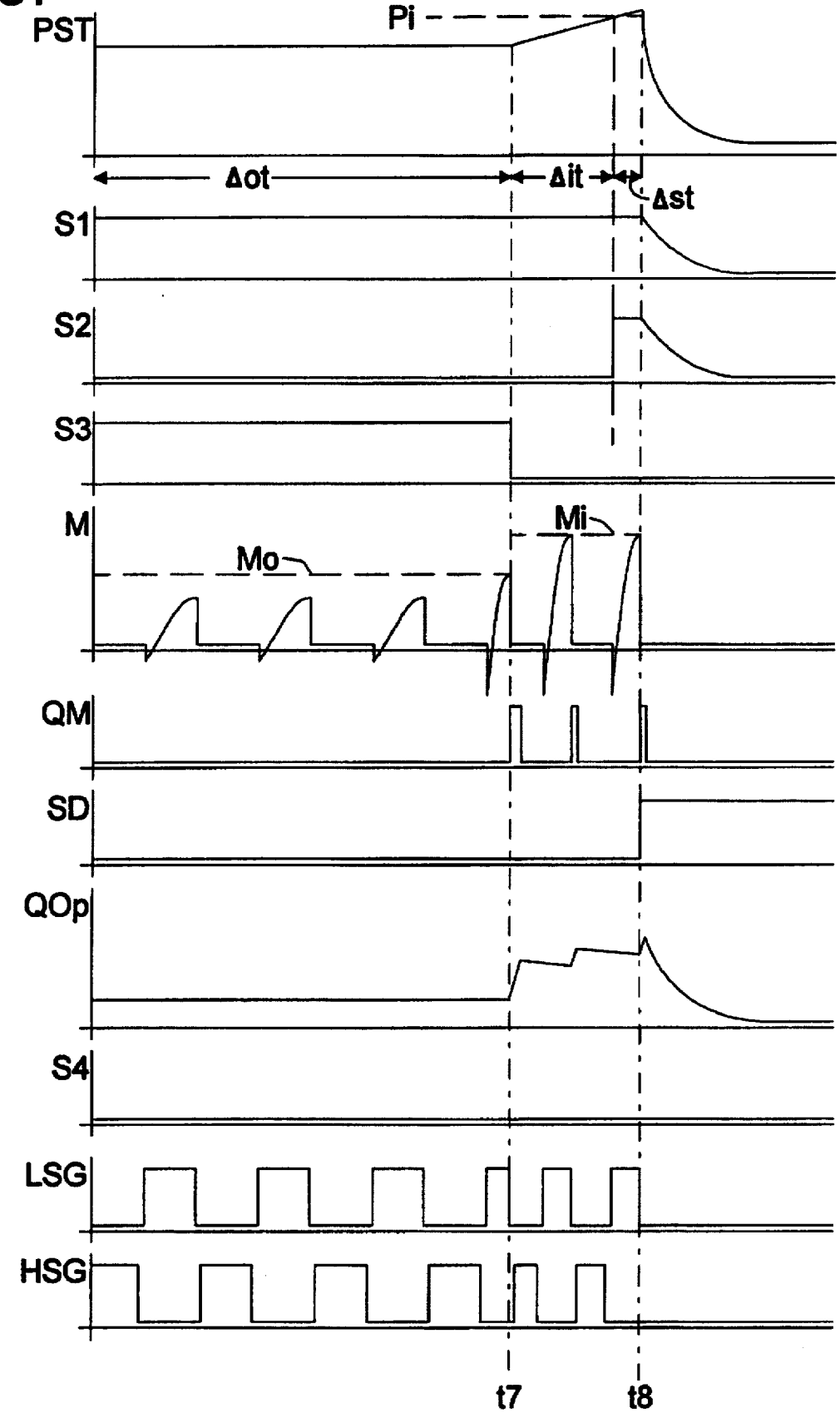
FIG. 4 shows, using timing diagrams corresponding to FIG. 3, the case of a disturbance in which the connected fluorescent lamp does not ignite properly within a predetermined time interval and, as a consequence, the electronic ballast is reset.
Figure 5:
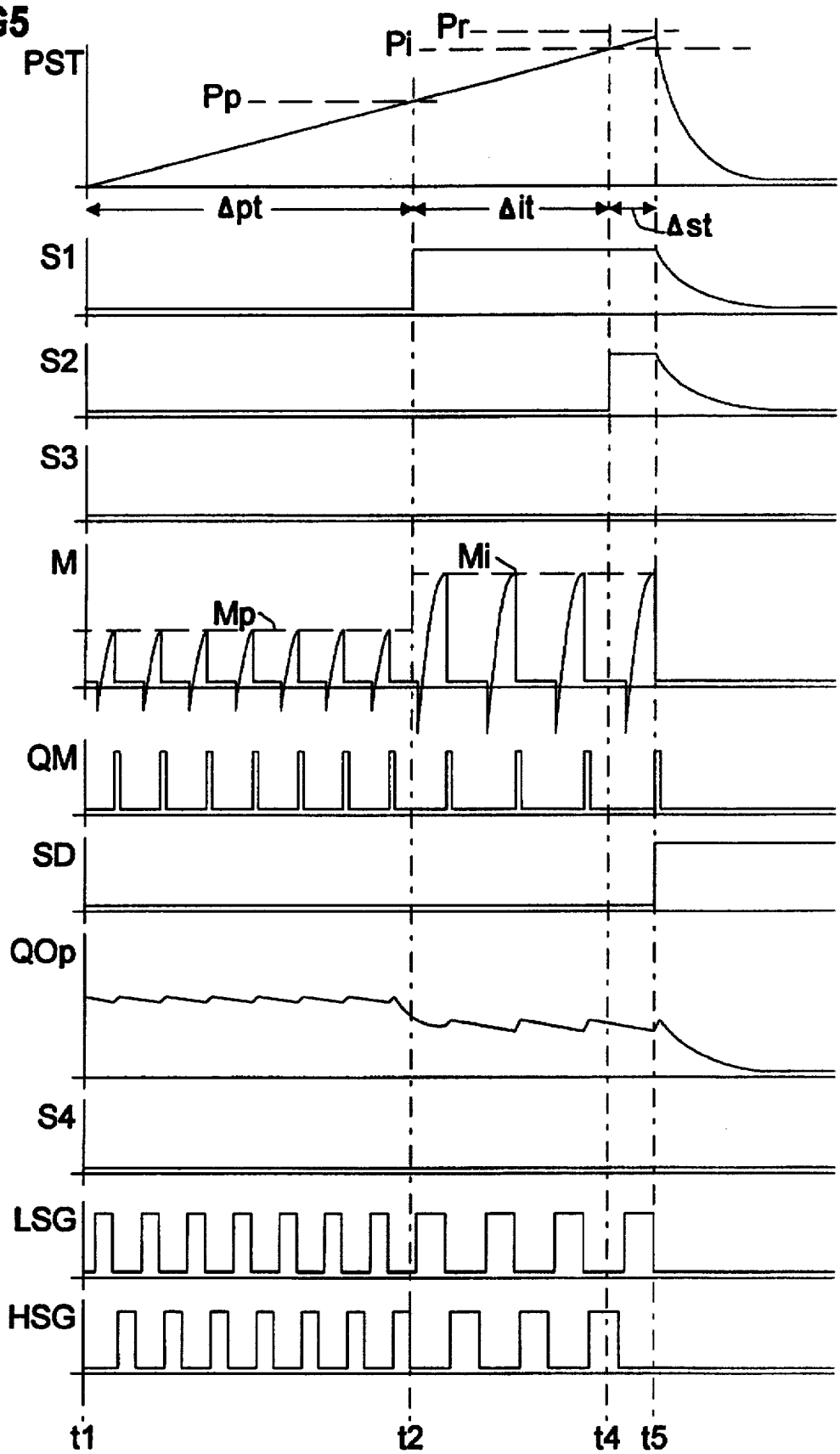
FIG. 5 shows, using corresponding timing diagrams, the evaluation of a disturbance which has occurred during operation of the fluorescent lamp which was proceeding normally until then.

The mode of operation of the circuit arrangement described with reference to FIG. 1 can best be explained in the form of timing diagrams, which are illustrated in FIGS. 3 to 5, assuming different operating states in the load circuit, that is to say particularly at the fluorescent lamp FL.

In this case, the timing diagrams of FIG. 3 illustrate a normal starting operation. As soon as the electronic ballast described is connected to mains voltage L, N, the turn-on comparator UVLO detects the supply voltage Vcc, which is increasing across its input, and activates the integrated circuit IC as soon as its turn-on threshold has been reached. Thereupon, the current-dependent oscillator CCO initially starts at a predetermined lower limiting frequency, which is for instance 75% of the maximum frequency. Not only the driver circuits HSD and LSD for the power transistors V2 and V3, respectively, of the half-bridge circuit but also the second internal current source ISC are made to operate—as described—by means of the selection circuit SEL which is activated by the pulse train of the current-dependent oscillator CCO. The second internal current source consequently begins to charge the capacitor Cc of the low-pass filter Rc, Cc accordingly, with the result that the described first control loop for the frequency control of the electronic ballast by means of the current-dependent oscillator CCO is started. The first internal current source IT assigned to the timer PST also begins to charge the external charging capacitor CT. As long as the first internal current source IT controlled by the monitoring circuit MON continues to charge this external charging capacitor, an initially linearly increasing voltage is supplied to the input of the timer PST. With predetermined reference levels of the timer PST, this input signal forms the time base for the control of all the functional sequences in the electronic ballast for different operating conditions.

The timing diagram of FIG. 3 will be used first of all to explain details of the sequence during normal starting of the lamp. t1 designates the starting instant at which, in the manner described above, the integrated circuit IC is made to operate in a defined manner when the mains voltage is connected. The very top diagram of FIG. 3 shows the voltage which increases linearly across the charging capacitor CT and is fed to the input of the timer PST. At a later instant t2, this input voltage for the timer PST reaches a predetermined lower reference level, which is designated as preheating level Pp. The time segment which proceeds from the turn-on instant t1 up to the later instant t2 forms a preheating phase Δpt for the electronic ballast. Hence, the instant t2 designates the instant of the end of this preheating phase. During this preheating phase, the first selection signal S1 of the timer PST is reset and hence the monitoring circuit MON is set at a low threshold value, the preheating threshold Mp. It thus detects, via the series resistor Rm connected to its input, the current, which is in the form of an exponential function, in the half-bridge circuit comprising the two power transistors V2, V3. The input signals of the monitoring circuit MON which are in the form of an exponential function and correspond to this current in the form of an exponential function are designated by M and reproduced in a corresponding section of the timing diagram of FIG. 3. As soon as these input pulses for the monitoring circuit MON reach the predetermined preheating threshold Mp in the preheating phase, the monitoring circuit MON emits in each case a short control pulse QM. Each of these control pulses QM emitted by the monitoring circuit MON causes the second internal current source ISC to be set and, furthermore, the selection circuit SEL, which operates in the manner of a flip-flop and is used for the driver circuits HSD and LSD, respectively, of the power transistors V2, V3 of the half-bridge circuit, to be changed over. The drive pulses HSG and LSG, respectively, emitted as a result by the driver circuits HSD and LSD, for the two power transistors V2 and V3, respectively, are reproduced in the bottom two timing diagrams in FIG. 3.

The end of the preheating phase Δpt at the instant t2 signals the timer PST by changing the switching state of the first selection signal S1 which is fed to the monitoring circuit MON. As a result, the said monitoring circuit is changed over to a second, higher threshold value, the ignition threshold Mi. This increase in the response threshold of the monitoring circuit MON causes the current in the half-bridge circuit, which is implemented by the two power transistors V2 and V3, to be increased to a predetermined and limited value which is allows the voltage across the fluorescent lamp FL to rise to the normal ignition voltage.

Accordingly, the ignition phase of the electronic ballast begins at the instant t2, which ignition phase must be concluded, in the case of a normally operating fluorescent lamp FL, by the time an instant t4 is reached, otherwise the electronic ballast is automatically disconnected. This maximum predetermined time segment for the duration of an ignition phase is designated by Δit in FIG. 3.

As in the preheating phase Δpt, the monitoring circuit MON carries on continuously monitoring the current flowing in the half-bridge circuit and each time the input signal M corresponding to the instantaneous half-bridge current concurs with the instantaneously activated threshold, now the ignition threshold Mi, the monitoring circuit emits one of the control pulses QM to the selection circuit SEL until the fluorescent lamp FL ignites. This is the case at the instant t3 in the normal ignition operation illustrated in FIG. 3. The monitoring circuit MQN does not emit any further control pulses QM once the fluorescent lamp FL has ignited, because now the half-bridge current no longer reaches the high ignition threshold Mi which is still activated in the monitoring circuit MON.

In spite of this, however, the external charging capacitor CT assigned to the timer PST is charged further, with the result that the input voltage fed to the timer PST continues to rise. The end of the predetermined maximum ignition phase Δit is reached at the instant t4. At this instant, the input signal of the timer passes through another of the predetermined reference levels, the ignition level Pi. If there were a fault, that is to say if the fluorescent lamp FL were reluctant to ignite, there would now have to be initiated an automatic reset of the electronic ballast. On account of this, the timer PST generates, starting at this instant t4, as a further output signal the second selection signal S2 which identifies a disconnection phase Δst. This second selection signal is fed to the disconnection circuit SD in order to enable it. However, the disconnection function is not carried out in the example according to FIG. 3, because the disconnection circuit SD does not receive any further control pulses QM, emitted by the monitoring circuit MON, at this instant in the case of a fluorescent lamp FL which ignites in good time. Incidentally, the ignition threshold Mi continues to be activated in the monitoring circuit MON.

Finally, the charging of the external charging capacitor CT reaches a value corresponding to a third reference level, the reset level Pr of the timer PST, at an instant t5. As a result of the further output signal S3 of the timer PST, the threshold to be detected is now lowered to a quiescent threshold Mo in the monitoring circuit MON, which quiescent threshold lies between the preheating threshold Mp and the ignition threshold Mi. Therefore, if a normally igniting fluorescent lamp FL is assumed, the monitoring circuit MON continues not to emit any control pulses, with the result that the enabled disconnection function cannot be activated. However, the discharging of the external charging capacitor CT assigned to the timer PST is initiated at this instant t5.

This discharging continues until the input signal of the timer PST has fallen to the ignition level Pi at the instant t6. As a result, the timer PST resets the second output signal S2 and inhibits the disconnection circuit SD. In contrast, the quiescent threshold Mo activated in the monitoring circuit MON remains unchanged. During the further course of events, the capacitor charge of the external capacitor CT assigned to the timer PST is reduced further until the input signal, derived therefrom, of the timer PST reaches a steady state at a quiescent level Po. Steady-state operation of a lit fluorescent lamp FL is thus achieved. The normal operating phase corresponding to this state is designated by Δot in the timing diagram of FIG. 3. In this case, the timer PST and the monitoring circuit MON are in a standby state and the driving of the power transistors V2, V3 is controlled solely by means of the first control loop OPR, CCO.

A first of the possible cases of disturbance is now illustrated in the timing diagram of FIG. 4. It is assumed here that a disturbance (for example due to the loss of gas in the case of intact lamp filaments) occurs during the steady-state operation of the lit fluorescent lamp FL and the fluorescent lamp FL is extinguished. Let this be the case at an instant t7. Until this point, the state and the functioning of the integrated circuit IC correspond to the above-described case in the normal operating phase Δot. At this instant, the monitoring circuit MON detects an input signal M, which is above the quiescent threshold Mo and corresponds to the instantaneous half-bridge current, and emits a control pulse QM. As a result, inter alia, the second internal current source IT is turned on again, that is to say the time base - in this case directly for a re-ignition phase Δit—is started. Alternatively, the current source may also be turned on again only when a plurality of control pulses QM are counted in a specific period of time.

The ignition threshold Mi is activated in the monitoring circuit MON and the monitoring circuit MON continually emits control pulses QM on account of the excessive current in the half-bridge circuit. The already explained operation for the ignition phase Δit now proceeds once more. In this case, however, the fluorescent lamp FL does not ignite in good time owing to the assumed disturbance. The disconnection circuit SD, which has already been enabled at the expiry of the ignition phase Δit by setting the second output signal S2 of the timer PST, is activated by a further control pulse QM emitted by the monitoring circuit MON, as is shown in FIG. 3 in the timing diagram designated by SD. In this case, too, it is possible as an alternative to count a plurality of events before the disconnection circuit SD is activated. The disconnection circuit SD deactivates the selection circuit SEL and at the same time resets the comparator UVLO. Incidentally, as is further illustrated in FIG. 4, all the functions of the integrated circuit IC which are essential for the lamp operation are reset into a defined starting state, with the exception of the disconnection circuit SD. After a lamp change or after reconnection of the mains voltage L, N, the electronic ballast is then ready for operation once more.

In contrast, if the disturbance assumed at the instant t7 had only been a brief disturbance, then although the above-described operations initiated at this instant would have started, they would not have been effected since, in the case of a disturbance which occurs only briefly, the monitoring circuit MON does not supply any further control pulses QM, which are derived from a continuous disturbance. In this case, the control operations would proceed in the integrated circuit IC as described, with reference to FIG. 3, after the ignition of the fluorescent lamp FL.

In contrast to a normal ignition operation in accordance with the timing diagram of FIG. 3, the basis of FIG. 5 is the case of a fluorescent lamp FL which does not ignite properly, in the case of which although there is no filament fault, it is nevertheless permanently reluctant to ignite, for example on account of loss of gas. In this case, the fluorescent lamp FL does not ignite right up to the expiry of the maximum predetermined ignition phase Δit. As a result, the disconnection circuit SD is enabled by the second selection signal S2 of the timer PST, the monitoring circuit MON detects further ignition attempts with excessive half-bridge current and emits further control pulses QM. As a result, the disconnection circuit SD is activated and shuts down the electronic ballast, as described above for a continuous operation disturbance. In this case, too, the disconnection is maintained until the mains voltage L, N is disconnected or the fluorescent lamp FL is changed.

However, account must also be taken of the fact that the filament resistance is greatly increased in the case of an aged fluorescent lamp FL and therefore it does not ignite normally. In this case, the starting operation proceeds up to the end of the preheating phase Δpt just like a normally igniting fluorescent lamp FL (FIG. 3) or alternatively like the fluorescent lamp FL which is reluctant to ignite on account of loss of gas (FIG. 5). However, in contradistinction to the fault case illustrated in FIG. 5, the superordinate mean current control, which is effective by means of the driving of the first power transistor V1, begins in the event of an impermissibly increased filament resistance. The mean current control limits the half-bridge current. As a consequence, the monitoring circuit MON does not generate any control pulses QM in the automatically initiated ignition phase Δit, because its input pulses M derived from the instantaneous half-bridge current do not reach the ignition threshold Mi. At the end of the ignition phase Δit, although the disconnection circuit SD is then enabled once more, it cannot be activated because the monitoring circuit MON, which is still set at the ignition threshold Mi, does not generate any control pulses QM. As the time base progresses, the timer PST then detects an input signal corresponding to its third threshold value, the reset threshold value Pr. At this instant, as in the case of a normal starting operation (FIG. 3), the reference level of the monitoring circuit MON is lowered to the quiescent threshold Mo, and the discharging of the external charging capacitor CT assigned to the timer PST is initiated. In this fault case of a used filament of the fluorescent lamp FL, although the half-bridge current is limited by the mean current control, it is now sufficient to permit the monitoring circuit MON to emit control pulses QM. Since the disconnection circuit SD is still enabled, it is thus activated and the described disconnection function is thus started. As described above, the electronic ballast is shut down, the disconnection being maintained until the mains voltage L, N is disconnected or the fluorescent lamp FL is changed.

The exemplary embodiments described illustrate that it is possible, by implementing a defined time base in conjunction with suitable continuous monitoring of the half-bridge current, to provide automatically proceeding functional sequences in the electronic ballast which reliably detect all the conceivably possible operating states of the fluorescent lamp FL to be operated and put the electronic ballast into a respectively adapted, defined state without any manual intervention. These functional sequences are configured in such a way that they can be implemented with particular elegance in a large-scale integrated circuit IC which is resistant to high voltages. In this case, not only is the high operational reliability of the entire lamp operating circuit important but also the particularly cost-effective mass production, because the electronic ballast of the described type can be implemented using an intrinsically small number of discrete components.

The invention is not limited to the particular details of the method and apparatus depicted and other modifications and applications are contemplated. Certain other changes may be made in the above described method and apparatus without departing from the true spirit and scope of the invention herein involved. It is intended, therefore, that the subject matter in the above depiction shall be interpreted as illustrative and not in a limiting sense.

What is claimed is:

1. A method for operating at least one fluorescent lamp using an electronic ballast which has a rectifier bridge having AC mains voltage across the bridge, a charging inductor which is connected to an output side of said rectifier bridge and said ballast having a connected charging diode, which is fed back to the rectifier bridge via a shunt capacitor, a half-bridge circuit connected to said changing diode and fed back to the rectifier bridge, said half-bridge circuit having two power transistors which are in series with one another and are activated alternatively, a control loop having a monitoring circuit for continuously monitoring lamp current of said at least one fluorescent lamp and having a high-frequency controlled drive circuit, derived from said monitoring circuit, for the power transistors, said ballast being connected to a load circuit which is arranged at an output of the half-bridge circuit and which has the at least one fluorescent lamp, an ignition inductor and an ignition capacitor, comprising the steps of:

starting a timer in a defined manner each time the lamp is started and each time a disturbance occurs during lit operation of the at least one fluorescent lamp, which timer generates a time base for subsequent control operations and respectively emits time control signals at predetermined time instants;

using said time control signals, setting respectively predetermined, different reference levels for lamp current to be detected are set in the monitoring circuit or preparing automatic disconnection of the electronic ballast for a predetermined, limited period of time comparing via the monitoring circuit an instantaneous value of the lamp current with a respectively activated reference level and emitting a respective control pulse when said activated reference level has been reached; and controlling the lamp current as a function of time using said control pulses, which reproduce normal or alternatively faulty states in the load circuit as a function of their occurrence or failure to occur during predetermined periods of time defined by the timer, wherein the control pulses act on the controlled drive circuit, in the event of an undisturbed operating state or wherein said control pulses trigger the prepared automatic disconnection of the electronic ballast when a fault occurs.

2. The method according to claim 1, wherein the time base supplied by the timer begins, during starting of the lamp, with a preheating phase, which is adjoined in direct chronological order by an ignition phase having a maximum duration, a disconnection phase and a normal operating phase, and wherein if a disturbance is detected during the normal operation, said time base begins directly at the ignition phase, with exclusion of a preheating phase, and wherein, at each transition instant from one time phase to a following time phase, the timer generates one of the time control signals respectively assigned to such time instants.

3. The method according to claim 2, wherein, in the monitoring circuit, a first reference level, which limits the lamp current to a relatively low value, is activated during the preheating phase, wherein a significantly higher, second reference level, which generates an increased ignition voltage across the fluorescent lamp, is activated in the ignition phase which comes next during starting of the lamp, and wherein a third reference level lying between the two other reference levels is activated in the normal operating phase, as a result of which an increase, which may also be only brief, in the lamp current above a predetermined value is detected as a disturbance, whereupon fault monitoring is triggered using the timer which is then reactivated from a standby state assigned to normal operation.

4. The method according to claim 2, wherein automatic disconnection, prepared at the beginning of the disconnection phase, of the electronic ballast is only triggered when, in said disconnection phase, the monitoring circuit continues to emit at least one control pulse and hence signals an impermissibly increased lamp current.

5. The method according to claim 1, wherein driving of the power transistors of the half-bridge circuit is inhibited in the controlled drive circuit as a result of automatic disconnection of the electronic ballast, and wherein said disconnection function is maintained for as long as a power supply of the integrated control loop is not interrupted.

6. An electronic ballast for operating at least one fluorescent lamp, comprising:

a rectifier bridge having AC mains voltage thereacross;

a step-up converter which is connected to an output side of said rectifier bridge;

a half-bridge circuit connected to said step-up converter, said half-bride circuit being fed back to the rectifier bridge and having two power transistors which are in series with one another and which are alternatively activatable;

a control loop having a monitoring circuit for continuously monitoring lamp current of the fluorescent lamp and having a high-frequency controlled drive circuit, derived from said monitoring circuit, for the power transistors;

a load circuit having the at least one fluorescent lamp, an ignition inductor and an ignition capacitor arranged at the output of the half-bridge circuit; the monitoring circuit, which is coupled to the half-bridge circuit, being a threshold value comparator which has a plurality of individually activatable reference levels and which generates a respective control pulse as soon as the pulse-shaped lamp current reaches an instantaneously activated reference level;

a controllable timer is assigned to the monitoring circuit, said controllable timer automatically builds up oscillations during starting of the lamp, or when a disturbance is detected, and prescribes for the control loop a time base with a series of defined periods of time, to which is assigned a respectively predetermined control signal which is emitted at the output of said timer and by means of which in each case one of the reference levels is activatable in the monitoring circuit;

a disconnection circuit for resetting the drive circuit when a fault occurs, to which disconnection circuit, which is connected at an input side to the timer, one of the emitted control signals is fed as an enable signal and which disconnection circuit, which is also connected to output of the monitoring circuit, is triggered by output-side control pulses monitoring circuit and keeps the electronic ballast reset for as long as a power supply of the control loop via the AC mains voltage is maintained.

7. The electronic ballast according to claim 6, wherein the timer includes a controllable internal current source having an output, the output of the current source being connected to a charging capacitor, as well as a further threshold value comparator having a plurality of predetermined threshold values, an input of the comparator connected to a junction point between the internal current source and the charging capacitor and which comparator generates, as a function of the charging of the charging capacitor, the assigned control signals, defining the predetermined periods of time, by means of a threshold value comparison.

8. The electronic ballast according to claim 7, wherein a control input of the internal current source is connected to the output of the monitoring circuit, resulting in the internal current source being activated by the control pulses of the monitoring circuit.

9. The electronic ballast according to claim 7, wherein the timer is furnished with first, second, third and fourth threshold values for evaluating a charging voltage rising continuously across the charging capacitor an end of a first period of time, defined as the preheating phase, as well as a beginning of a second period of time, defined as the ignition phase having a predetermined maximum duration, being established when the charging voltage passes through the first, low threshold value, a transition from the ignition phase to a disconnection phase being determined by passage of the charging voltage through the second threshold value, an end of the disconnection phase being reached when the charging voltage passes through the third threshold value having a maximum level, and the fourth threshold value, the level of which lies between the first threshold value and the second threshold value, corresponding during steady-state lit operation of the fluorescent lamp to an operating level at which the timer is kept in a standby state.

10. The electronic ballast according to claim 9, wherein the monitoring circuit is a further threshold value comparator having three reference levels which are individually activatable by the timer, a first reference level being assigned to the preheating phase, during which the monitoring circuit, limiting the lamp current, generates a series of control pulses in this preheating phase, a second, high reference level being assigned to the ignition phase and the subsequent disconnection phase, during which the monitoring circuit continues to emit control pulses for as long as ignition attempts continue, and a third reference level, which may, if appropriate, be identical to the first reference level, is assigned to the steady-state operation of a fluorescent lamp which is lit without any faults, in which state the monitoring circuit is in a standby state and does not emit any control pulses.

11. The electronic ballast according to claim 9, wherein the drive circuit has a selection circuit having two mutually inversely activated outputs via which in each case one of the two power transistors of the half-bridge circuit is driven alternatively and having a first control input connected to the output of the monitoring circuit as well as a further control input, and wherein a current-controlled radiofrequency oscillator is coupled on the input side to the half-bridge circuit, an output of which being connected to the second control input of the selection circuit, wherein the radiofrequency oscillator has a control loop, which keeps the lamp or half-bridge current constant at a predetermined mean, in particular during steady-state lit operation of the fluorescent lamp, and superordinate current control, which identifies, limits and controls a peak current during starting of the lamp and in the case of a disturbance, being provided in conjunction with the monitoring circuit.

12. The electronic ballast according to claim 6, wherein the control loop has a controlled power supply having an input for the supply voltage which is connected via a further capacitor to reference potential and is connected in parallel therewith, via a series circuit of two diodes, likewise to the reference potential, wherein a further capacitor is connected to a junction point of said diodes and the output of the half-bridge circuit, and wherein an electronic switch is provided for regulated control of charge of said further capacitor and is controlled such that the switch is activated once the supply voltage has exceeded a predetermined upper tolerance the charge of the further capacitor, and is inhibited when the supply voltage has fallen below a predetermined lower tolerance, and the charge of the further capacitor is fed once more to the capacitor.

13. The electronic ballast according to claim 12, wherein the electronic switch is a switching transistor and is arranged with its collector-emitter path between the junction point of the two series-connected diodes and a reference potential, and a low-inertia, further comparator is provided, to which is fed the supply voltage for evaluation with regard to an upper threshold value and a lower threshold value and to an output of which is connected the control input of the switching transistor.

14. The electronic ballast according to claim 12, wherein the power supply of the control loop additionally has a voltage-proof turn-on comparator, which is connected to the input for the supply voltage, has a high input resistance until a predetermined starting voltage is reached and to the output of which are connected a DC voltage source for generating a reference voltage as a defined reference potential for control operations in the control loop as well as, in parallel therewith, a further controlled current source for the internal DC supply of the control loop.

15. The electronic ballast according to claim 14, wherein the turn-on comparator is connected by a control input to the output of the disconnection circuit, via which control input the turn-on comparator can be switched into its high-resistance state in a reset state of the control loop.

16. The electronic ballast according to claim 14, wherein the current-controlled radiofrequency oscillator has a further internal, controlled current source having a set input connected to the monitoring circuit and a reset input connected to one of the outputs of the selection circuit, an output of said current source being connected via a further external capacitor to a reference potential or a connection of the rectifier bridges which carries a low potential, and wherein a control operational amplifier is provided, the control operational amplifier having a non-inverting input connected via a further series resistor to the output of the half-bridge circuit, fed an input signal corresponding to an instantaneous value of the lamp current, and having an inverting input connected to a junction point between the controlled internal current source and the external capacitor, the inverting input being fed an input signal corresponding to the charge state of this capacitor, and an output of the control operational amplifier, which is decoupled by means of a decoupling diode, connected to said junction point between the controlled internal current source and the external capacitor as well as, to a control input of the current-controlled oscillator.

17. The electronic ballast according to claim 16, wherein the electronic ballast comprises:

a further differential voltage amplifier, which is used as a comparator and an inverting input of which is connected to the reference voltage as the reference potential and the non-inverting input of which is connected via the decoupling diode to the output of the control operational amplifier, as a result of which it is possible to detect by said comparator when the control operational amplifier leaves a defined control range thereof, whereupon the comparator generates a further control signal which is fed to the monitoring circuit and effects in the monitoring circuit a lowering of the predetermined reference levels thereof.

* * * * *